US006269862B1

(12) United States Patent
Richards et al.

(10) Patent No.: US 6,269,862 B1
(45) Date of Patent: Aug. 7, 2001

(54) MOULD LUBRICANT

(75) Inventors: Cheryl Richards, Watsonia; Stephen Ronald Peck, Bardon; Phillip Wilmott Baker, Indooroopilly, all of (AU)

(73) Assignee: Cast Centre Pty Ltd., St. Lucia (AU)

( * ) Notice: Subject to any disclaimer, the term of this patent is extended or adjusted under 35 U.S.C. 154(b) by 0 days.

(21) Appl. No.: 09/319,302

(22) PCT Filed: Dec. 5, 1997

(86) PCT No.: PCT/AU97/00829

§ 371 Date: Aug. 19, 1999

§ 102(e) Date: Aug. 19, 1999

(87) PCT Pub. No.: WO98/24572

PCT Pub. Date: Jun. 11, 1998

(30) Foreign Application Priority Data

Dec. 5, 1996 (AU) ..... PO 4019

(51) Int. Cl.[7] ..... B22D 11/07; B22D 11/00; B22D 27/15; B28B 7/36

(52) U.S. Cl. ..... 164/472; 164/487; 164/474; 164/475; 164/61; 164/66.1; 106/38.2; 106/38.22

(58) Field of Search ..... 164/472, 66.1, 164/487, 474, 475, 61, 259, 900; 106/14.22, 14.26, 38.2, 38.22, 38.24, 38.7; 427/133, 135; 420/402

(56) References Cited

U.S. PATENT DOCUMENTS 2,045,913 6/1936 Hoy et al. .
3,034,186 * 5/1962 Holshouser ..... 22/200.1
3,400,752 * 9/1968 Unsworth et al. ..... 164/66.1
3,978,908 * 9/1976 Klaus et al. ..... 164/72
4,930,566 * 6/1990 Yanagimoto et al. ..... 164/475
5,325,910 * 7/1994 Schneider et al. ..... 164/472
5,913,353 * 6/1999 Riley et al. ..... 164/113

OTHER PUBLICATIONS

Japatic Abstract of JP 57–103758 (Shin Nippon Seitetsu KK) 6/82.

Japatic Abstract of JP 56–154260 (Shin Nippon Seitetsu KK) 11/81.

Japatic Abstract of JP 58–77752 (Shin Nippoon Seitetsu KK) 5/83.

Derwent Abstract of JP 51–013329 (Hikari Kagaku KK) 2/76.

Derwent Abstract of JP 51–050221 (Hikari Kagaku Kogyo) 5/76.

* cited by examiner

*Primary Examiner*—Tom Dunn
*Assistant Examiner*—Kevin P. Kerns
(74) *Attorney, Agent, or Firm*—Rodman & Rodman

(57) ABSTRACT

A method for preparing a mould lubricant for use in direct chill casting of reactive metals, including magnesium, magnesium alloys, aluminum, and aluminum alloys, proceeds through combining a casting lubricant and a gaseous oxidation-inhibiting agent in a vessel external from the mold under vacuum conditions. The casting lubricant is selected from a variety of casting oils and casting greases. The gaseous oxidation-inhibiting agent is selected from a variety of inert gases, including sulfur hexafluoride ($SF_6$).

14 Claims, No Drawings

MOULD LUBRICANT

FIELD OF THE INVENTION

The present invention relates to a mould lubricant, to a method for direct chill casting of a reactive metal which utilizes the mould lubricant, and to a reactive metal cast by the method. The expression reactive metal includes magnesium, magnesium alloys, aluminum and aluminium alloys (for example, aluminium/lithium alloys). Throughout this specification, the present invention will be described in relation to magnesium but it is to be understood that the present invention is applicable to other reactive metals.

BACKGROUND ART

Direct chill casting is a process in which molten metal is fed to a water-cooled mould and a cast metal strand is withdrawn from the mould. Direct chill casting includes horizontal direct chill casting and vertical direct chill casting. The strand withdrawn from She mould consists of a solid shell surrounding a liquid core which subsequently solidifies. The strand is sprayed with cooling water as it exits the mould to both cool the strand and to extract additional heat from within the water-cooled mould. A casting lubricant is used in direct chill casting to reduce friction between the solidified shell and the face of the mould for the deal purposes of reducing mould wear and avoiding tearing of the shell.

Casting lubricants include casting oils and casting greases. Casting oils are typically continuously fed to the interface between the face of the mould and the metal by an arrangement which is either integrally formed with the mould or which is separately constructed to function with the mould. Casting greases may be applied manually by brushing the face of the mould prior to casting or by use of an automatic grease lubricating system such as that disclosed in International Publication No. WO 94/00258. casting lubricants require high thermal stability and resistance to oxidative degradation at high temperatures. Throughout this specification, the expression "casting lubricant" is to be understood to include such casting oils and greases and includes animal, vegetable, synthetic and mineral casting oils and greases such as vegetable shortening, lard used in baking, castor oil, rape seed oil, esters, paraffins and synthetic liquids.

Magnesium is a highly reactive and thermodynamically unstable element with molten magnesium readily oxidizing in ambient air. Three approaches have been used to inhibit the severe oxidation process. Salt cover fluxes may be sprinkled over the molten metal; oxygen may be excluded from contacting the molten metal by blanketing the molten metal with an inert gas such as helium, nitrogen or argon; or a protective cover gas may be used to blanket the molten metal. Protective cover gases typically comprise air and/or carbon dioxide and a small amount of an inhibiting agent which reacts/interacts with the molten metal to form a film/layer on the molten metal which protects it from oxidation. The mechanism by which inhibiting agents protect molten reactive metals is not well understood.

U.S. Pat. No. 1,972,317 was filed in 1932 and teaches a method for inhibiting the oxidation of readily oxidizable metals (for example, magnesium) by maintaining a fluorine containing atmosphere in contact with the surface of the metal. Lines 70–74 of the patent state, "The present invention is not concerned with, nor do the claims cover, any step in which the inhibition of detrimental attack by atmospheric gases upon magnesium takes place within a casting mould."

U.S. Pat. No. 3,034,186 was filed in 1956 and teaches an aluminum casting lubricant consisting of a dispersion of solid boric acid ($H_3BO_3$) in a suitable oil or oily based material. The casting lubricant is said to inhibit metal oxidation on ingot surfaces and prevent magnesium burning in aluminum alloys with high magnesium content. The casting lubricant is believed to have never been commercially used.

U.S. Pat. No. 4,930,566 teaches a method for continuous casting of an aluminium-lithium alloy through an open-ended mould which is lubricated by a casting lubricant. Pressurized gas is directed into the mould to contact the molten metal immediately prior to solidification to displace the point at which tile metal contacts the mould. The gas comprises 1–15% by volume oxygen with the balance being an inert and incombustible gas such as nitrogen, argon, carbon dioxide, helium or a mixture thereof. A variation of the teaching of U.S. Pat. No. 4,930,566 relates to the casting or magnesium in which the pressurized gas is carbon dioxide containing 10% sulphur hexafluoride ($SF_6$). The gas and the casting lubricant are separately introduced into the mould.

CA 2047384 reaches a method for vertical direct chill casting in which a casting lubricant is used to lubricate the mould and a protective gas containing a high concentration of an inhibiting agent such as $SF_6$ is drawn into the mould by a self-generating vacuum.

JP 2-277098 teaches a non-ferrous metal casting lubricant consisting of a plant oil lubricant containing 0.5–3% by weight ot powdered boron nitride which is said to improve lubricating properties and reduce the amount of lubricant required as compared with plant oil lubricant alone.

SUMMARY OF THE PRESENT INVENTION

In a first aspect, the present invention provides a mould lubricant comprising a casting lubricant containing a gaseous oxidation inhibiting agent.

Gaseous oxidation inhibiting agents include inert gases such as nitrogen ($N_2$) and argon (Ar) and sulfur or fluorine containing gases such as sulfur dioxide ($SO_2$), sulfur hexafluoride ($SF_6$), boron trifluoride ($BF_3$), sulfur and fluorine containing gases as described in U.S. Pat. No. 1,972,317, and mixtures thereof.

The mould lubricant according to the first aspect of the present invention may be prepared by evacuating the casting lubricant and returning it to a desired pressure by introduction of the gaseous oxidation inhibiting agent.

In a second aspect, the present invention provides a method for direct chill casting of a reactive metal through a mould, the method comprising lubricating the mould with a mould lubricant according to the first aspect of the present invention.

The method according to the second aspect of the present invention can be applied to the casting of reactive metals in conventional horizontal or vertical direct chill casting equipment by substituting the conventional casting lubricant with a mould lubricant according to the first aspect of the present invention.

The mould lubricant may be introduced to the mould from a reservoir where it is maintained at, above, or below atmospheric pressure.

In a third aspect, the present invention provides a reactive metal cast by the method according to the second aspect of the present invention.

Although the precise mechanism is not well understood, it is believed that surface oxidation of a reactive metal cast according to the second aspect of the present invention is minimized by the presence of the gaseous oxidation inhibiting agent which reacts or interacts with the surface of the molten reactive metal.

Embodiments of the present invention will now be described by way of example only.

EXAMPLE 1

A mould lubricant according to the first aspect of the present invention was prepared by dissolving $SF_6$ in canola oil.

A 500 ml sample of canola oil was placed in a clean dry vacuum flask end evacuated to 70 kPa for approximately 14 hours. The evacuated oil flask was agitated and returned to atmospheric pressure by slowly bubbling $SF_6$ into the oil with an $SF_6$ atmosphere being maintained above the oil. The flask was weighed before evacuation and after $SF_6$ addition with the weight increase being 3.78 grams. Samples of the resulting mould lubricant and untreated canola oil were analyzed by gas chromatography. The untreated sample was found to contain approximately 6.6% by weight dissolved air and no $SF_6$. The mould lubricant was found to contain approximately 4.7% by weight $SF_6$ and approximately 5.8% by weight air.

EXAMPLE 2

A strand of magnesium was cast on a Hertwich horizontal direct chill casting machine fitted with a standard 100 mm×100 mm square cross-section mould using a mould lubricant prepared. according to Example 1 to lubricate the mould.

Prior to casting, the standard oil reservoir was thoroughly cleaned, new oil lines were fitted to the oil injectors and new refractory components were fitted to the mould. The mould lubricant was placed in the oil reservoir and $SF_6$ was bubbled into the mould lubricant in the oil reservoir to maintain an $SF_6$ blanket above the oil to minimize liberation of $SF_6$ from the mould lubricant.

As is conventional, the mould lubricant was brought up to the mould from the oil reservoir via the oil lines and oil injectors and smeared over the face of the mould prior to the commencement of casting. A magnesium strand was cast at a casting speed of 300 mm/min and the surface of the strand ways bright. and shiny immediately after casting indicating that the presence of $SF_6$ in the mould lubricant had inhibited oxidation of the surface of the magnesium strand. The surface of the strand was analyzed by X-ray Photoelectron Spectroscopy (XPS) which indicated the presence of a fluoride film on the surface of the strand.

Comparative Example 1

A comparative casting trial was performed which was identical in all respects to Example 2 except that the mould lubricant was replaced by untreated canola oil and $SF_6$ was not bubbled into the oil reservoir. Immediately after casting, the resulting strand of magnesium had a discolored surface featuring blackened areas which were believed to be due to oxidation.

What is claimed is:

1. A process for forming a mould lubricant comprising an oil or grease casting lubricant and a gaseous oxidation-inhibiting agent to be used in the direct chill casting of a reactive metal through a cooled mould, comprising:

(a) placing an oil or grease casting lubricant in an external vessel under vacuum conditions;

(b) introducing a gaseous oxidation-inhibiting agent into the external vessel under vacuum conditions until atmospheric pressure is reached, whereby the gaseous oxidation-inhibiting agent contacts and becomes absorbed in the casting lubricant to thereby form the mould lubricant.

2. The process of claim 1, wherein the casting lubricant is an oil.

3. The process of claim 1, wherein the casting lubricant is a grease.

4. The process of claim 1, wherein the gaseous oxidation-inhibiting agent is selected from the group consisting of nitrogen, argon, sulfur-containing gas, and fluorine-containing gas.

5. The process of claim 1, wherein the gaseous oxidation-inhibiting agent is sulfur hexafluoride.

6. A method for the direct chill casting of a reactive metal through a cooled mould, wherein molten metal is fed of a direct chill casting apparatus to the cooled mould and a cast metal strand is withdrawn therefrom, the improvement of which comprises:

(a) placing an oil or grease casting lubricant in an external vessel under vacuum conditions;

(b) introducing a gaseous oxidation-inhibiting agent into the external vessel under vacuum conditions until atmospheric pressure is reached, whereby the gaseous oxidation-inhibiting agent contacts and becomes absorbed in the casting lubricant to thereby form a mould lubricant; and (c) transferring the mould lubricant from the external vessel into the direct chill casting apparatus and contacting it to the surface of the mould prior to commencement of casting.

7. The method of claim 6, wherein the reactive metal is selected from the group consisting of magnesium, magnesium alloys, aluminum, and aluminum alloys.

8. The method of claim 6, wherein the reactive metal is selected from the group consisting of magnesium and magnesium alloys.

9. The method of claim 6, wherein the reactive metal is selected from the group consisting of aluminum and aluminum alloys.

10. A process for preparing a mould lubricant for use in direct chill casting of a reactive metal through a direct chill mould, the mould lubricant comprising a casting lubricant and a gaseous oxidation-inhibiting agent and the process comprising combined the casting lubricant and the gaseous oxidation-inhibiting agent externally of the mould for subsequent delivery to the mould.

11. A process as claimed in claim 10, wherein the casting lubricant is a casting oil and the casting oil and the gaseous oxidation-inhibiting inhibiting agent are combined by placing the casting oil in a vessel, subjecting the vessel to a partial vacuum, and introducing the gaseous oxidation-inhibiting agent into the partially evacuated vessel.

12. A process as claimed in claim 10, wherein the casting lubricant is a casting oil and the casting oil and the gaseous oxidation-inhibiting agent are combined by bubbling the gaseous oxidation-inhibiting agent into the casting oil.

13. A method for lubricating a direct chill mould in the direct chill casting of a reactive metal, the method comprising the steps of:

(a) preparing a mould lubricant comprising a casting lubricant and a gaseous oxidation-inhibiting agent by combining the casting lubricant and the gaseous oxidation-inhibiting agent externally of the mould; and (b) delivering the mould lubricant to the mould for lubrication thereof.

14. A method as claimed in claim 13 wherein the mould lubricant is delivered to the direct chill mould from a mould lubricant reservoir located externally of the mould and wherein gaseous oxidation-inhibiting agent is bubbled into the mould lubricant within the reservoir to maintain an atmosphere substantially of gaseous oxidation-inhibiting agent above the mould lubricant in the reservoir.

* * * * *

UNITED STATES PATENT AND TRADEMARK OFFICE

CERTIFICATE OF CORRECTION

PATENT NO. : 6,269,862 B1
DATED : August 7, 2001
INVENTOR(S) : Cheryl Richards, Phillip W. Baker and Stephen R. Peck It is certified that error appears in the above-identified patent and that said Letters Patent is hereby corrected as shown below:

Column 1,
Line 19, change "She" to -- The --.
Line 25, change "deal" to -- dual --.

Column 2,
Line 14, change "tile" to -- the --.
Line 19, change "or" to -- of --.
Line 29, change "ot" to -- of --.

Column 3,
Line 47, change "ways" to -- was --.

Column 4, claim 6,
Lines 18-19, change "of a direct chill casting apparatus to the cooled mould" to -- to the cooled mould of a direct chill casting apparatus --.

Column 4, claim 10,
Line 54, change "combined" to -- combining --.

Column 4, claim 11,
Line 59, delete "inhibiting" (second occurrence).

Signed and Sealed this

Sixteenth Day of April, 2002

*Attest:*

*Attesting Officer*

JAMES E. ROGAN
*Director of the United States Patent and Trademark Office*